US010134544B2

(12) United States Patent
Barenghi

(10) Patent No.: US 10,134,544 B2
(45) Date of Patent: Nov. 20, 2018

(54) CONTROL DEVICE WITH LIMIT SWITCHES

(71) Applicant: EISENBAU S.R.L., Cusago (MI) (IT)

(72) Inventor: Barbara Barenghi, Milan (IT)

(73) Assignee: EISENBAU S.R.L., Cusago (MI) (IT)

( * ) Notice: Subject to any disclaimer, the term of this patent is extended or adjusted under 35 U.S.C. 154(b) by 0 days.

(21) Appl. No.: 15/535,769

(22) PCT Filed: Dec. 4, 2015

(86) PCT No.: PCT/IB2015/059352
§ 371 (c)(1),
(2) Date: Jun. 14, 2017

(87) PCT Pub. No.: WO2016/097916
PCT Pub. Date: Jun. 23, 2016

(65) Prior Publication Data

US 2017/0330711 A1 Nov. 16, 2017

(30) Foreign Application Priority Data

Dec. 15, 2014 (IT) ..... MI2014A2135

(51) Int. Cl.

| | |
|---|---|
| ***H01H 13/18*** | (2006.01) |
| ***H01H 19/62*** | (2006.01) |
| ***H01H 19/04*** | (2006.01) |
| ***H01H 19/14*** | (2006.01) |
| *H01H 3/16* | (2006.01) |
| *H01H 3/18* | (2006.01) |

(Continued)

(52) U.S. Cl.
CPC ..... *H01H 19/623* (2013.01); *H01H 13/18* (2013.01); *H01H 19/04* (2013.01); *H01H 19/14* (2013.01); *H01H 3/16* (2013.01); *H01H 3/18* (2013.01); *H01H 3/42* (2013.01); *H01H 2003/323* (2013.01)

(58) Field of Classification Search
CPC .... H01H 19/62; H01H 19/623; H01H 43/128; H01H 43/127; H01H 9/0207
USPC ... 200/38 BA, 574, 286, 38 B, 11 R, 11 TW, 200/17 R, 19.2, 19.21, 38 CA
See application file for complete search history.

(56) References Cited

U.S. PATENT DOCUMENTS 5,298,700 A 3/1994 Champagne et al.
5,357,067 A 10/1994 Keck

FOREIGN PATENT DOCUMENTS

FR 2344886 A1 10/1977
GB 2265204 A 9/1993

OTHER PUBLICATIONS

International Search Report and Written Opinion for International Application No. PCT/IB2015/059352 (dated Mar. 21, 2016)(10 Pages).

*Primary Examiner* — Ahmed Saeed
(74) *Attorney, Agent, or Firm* — Lucas & Mercanti, LLP

(57) ABSTRACT

A control device with limit switches is provided. The device has a container housing an electric circuit provided with one or more limit switches, and a driving assembly configured to control operation of a valve or an actuator through the limit switches of the electric circuit. The driving assembly has a shaft configured to be rotatably coupled to a valve or an actuator and one or more cams keyed on the shaft and is configured for driving the limit switches of the electric circuit. The shaft has a gripping surface and each cam has a radial clamping mechanism whose gripping members are (Continued)

arranged in correspondence of a through hole configured to allow to fit the cam onto the shaft.

16 Claims, 5 Drawing Sheets

(51) Int. Cl.
*H01H 3/42* (2006.01)
*H01H 3/32* (2006.01)

CONTROL DEVICE WITH LIMIT SWITCHES

CROSS-REFERENCE TO RELATED APPLICATIONS

This application is a 371 of PCT/M2015/059352, filed Dec. 4, 2015, which claims the benefit of Italian Patent Application No. MI2014A002135, filed Dec. 15, 2014.

FIELD OF THE INVENTION

The present invention generally relates to devices for controlling the position of manually or automatically operated valves and actuators, such as e.g. control devices used in chemical and petrochemical plants, and in particular to a control device with limit switches that are operated by way of cams.

BACKGROUND OF THE INVENTION

There are known control devices with limit switches referred to as "Limit Switch Boxes" used to control the position of valves and actuators. These devices comprise an electric circuit on which one or more limit switches are mounted, as well as a driving assembly comprising a shaft connectable to a valve or to an actuator through a suitable coupling. The driving assembly further comprises one or more cams keyed on the shaft and configured to interact with the respective limit switches so as to enable or inhibit operation of the valve or actuator.

Switches having a push button may be directly controlled by the cams, whereas limit switches in the form of proximity sensors may be controlled indirectly by way of a ferromagnetic material element or a magnet associated with the cams.

The driving assembly and the electrical circuit are generally accommodated in a container that protects them from atmospheric agents and which may be optionally configured to resist fire and/or explosion. The container is typically provided with a plurality of openings configured to allow passage of electric cables and an visual position indicator associated with the shaft. This allows operators to quickly obtain information about the position of a valve or actuator, corresponding to what is detected by the limit switches.

The driving assemblies employed in control devices with limit switches are standardized components provided with means for adjusting the angular position of the cams, which allows to arrange them according to the position of the respective switches and/or proximity sensors mounted on the electric circuit of a specific device.

Known control devices with limit switches comprise shafts on which one or more annular elements are keyed on whose peripheral walls a plurality of alternating lands and grooves are formed in a longitudinal direction that together define a ribbed surface. On these surfaces it is possible to engage respective cams by way of a shape coupling. For this purpose the surface of the mounting hole of each cam comprises a plurality of longitudinal lands and grooves whose shape corresponds to the shape of the lands and grooves of the ribbed surface of the annular elements.

The cams are axially movable relative to the respective annular elements between a locking position, wherein the ribbed surfaces are coupled with each other, and an unlocking position, wherein the ribbed surfaces are disengaged and each cam may freely rotate about the shaft, whose cross section has a diameter smaller than the diameter of the annular elements.

By temporarily removing the shape coupling between cams and shaft, it is thus possible to change their relative position, which allows to configure the driving assembly they form so as to allow to assemble it in a control device provided with a specific electrical circuit with limit switches.

In order to allow maintenance of the relative position between the annular elements and the respective cams in the locked position, the cams are urged into this position by coil springs suitably keyed on the shaft and axially restrained thereto. The axial movement of each cam along the shaft is limited by abutment surfaces formed at one end of the mounting hole opposite to the end facing the respective annular element.

The publication U.S. Pat. No. 5,298,700 A discloses a module for limit switch boxes. The module comprises a shaft that may be rotatably coupled to a valve or an actuator and one or more cams keyed on the shaft and configured to drive limit switches. The shaft comprises a gripping surface and each cam comprises a radial clamping mechanism whose gripping members are arranged at a respective through hole configured to allow to assemble the cam on the shaft.

SUMMARY OF THE INVENTION

The driving assemblies of the control devices with limit switches are perfectible both concerning the structure of the individual components and in terms of manufacturing costs, which is an object of the present invention.

Said object is achieved with a control device whose main features are specified in the first claim, while other features are specified in the remaining claims.

An idea of solution underlying the invention is to integrate in the individual cams of the driving assembly a radial clamping mechanism arranged in correspondence of the respective mounting holes and configured to engage a gripping surface formed on the shaft. It is also an idea of solution to configure each cam so that it comprises a container wherein a plurality of gripping members are arranged together with moving means defining the radial clamping mechanism with them. The gripping members driven by the moving means are moveable to and from the axis of an assembly through hole formed in the container.

This configuration allows to completely solve problems related to manufacturing tolerances of the gripping members arranged between the cams and the shaft, because approaching and retracting radial movements are used to lock and unlock the cams.

Moreover, since locking and unlocking of the cams is achieved by way of a mechanism arranged inside the cams, it is possible to key them on the shaft also in contact with each other in the axial direction, which allows to adapt the driving assembly formed by shaft and cams to any possible arrangement of the switches mounted on the electric circuit of the control device intended to receive the driving assembly.

Another advantage offered by the invention is that the locking and unlocking system of the individual cams cannot be damaged nor tampered, because it is completely housed therein.

Furthermore, unlike known control devices, the locking and unlocking system of the individual cams does employ springs, thereby eliminating their assembly operations and possible yield stress problems.

BRIEF DESCRIPTION OF THE DRAWINGS

Further advantages and features of the control device with limit switches according to the present invention will become clear to those skilled in the art from the following detailed and non-limiting description of embodiments thereof, with reference to the accompanying drawings wherein:

FIG. 3 is an exploded perspective view of a cam of the;

DETAILED DESCRIPTION OF THE INVENTION

Figure 1:
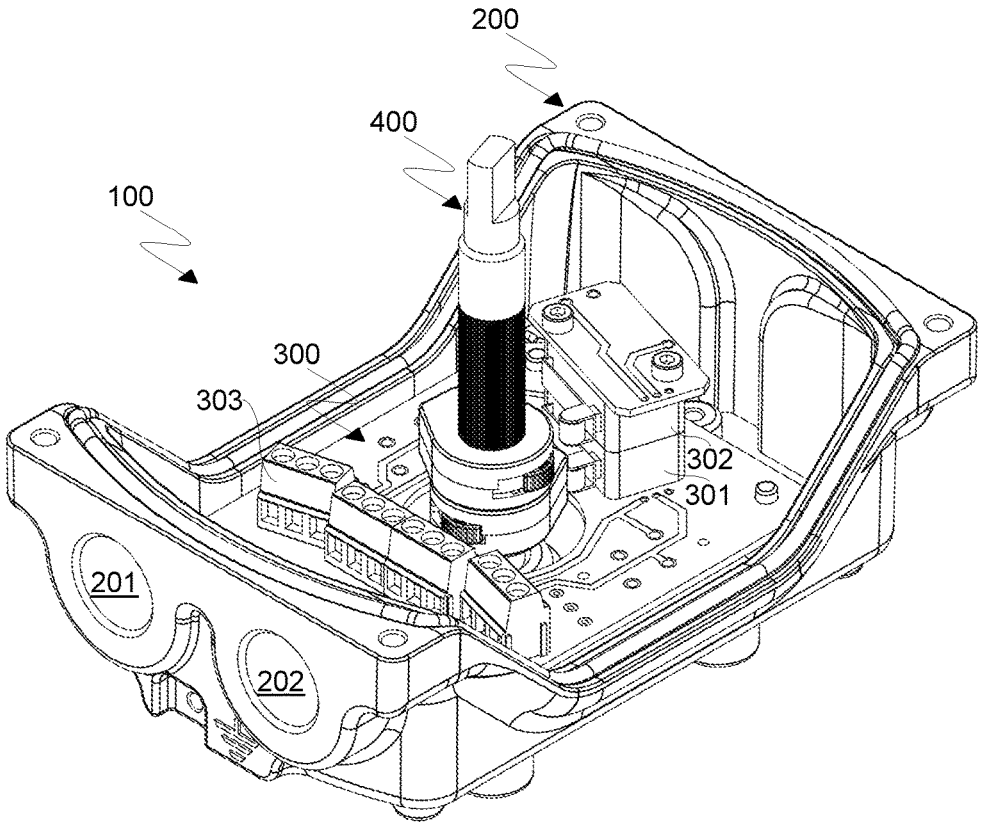
FIG. 1 is a perspective view showing a control device with limit switches according to the invention.
Figure 2:
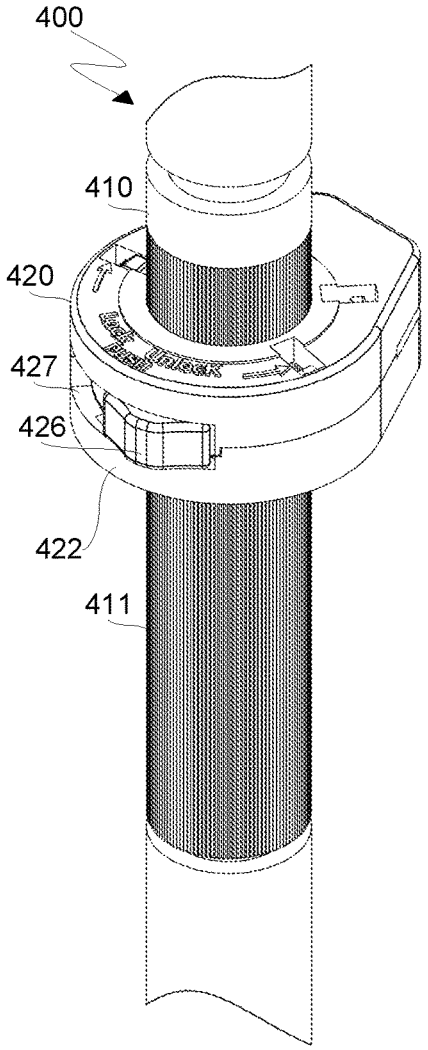
FIG. 2 is a perspective view showing the a driving assembly of the device of FIG. 1 on which a single cam is keyed.

Referring to FIGS. 1 and 2, a control device with limit switches according to the invention is generally indicated by the reference numeral 100.

The device 100 comprises a container 200 wherein an electric circuit 300 provided with one or more limit switches is housed, for example two limit switches 301, 302. A driving assembly 400 configured to control operation of a valve or an actuator through the switches of the electric circuit 300 is also housed in the container 200.

The driving assembly 400 comprises a shaft 410 configured to be rotatably coupled to a valve or an actuator (not shown) and one or more cams keyed on the shaft 410 and configured to drive the limit switches of the electric circuit 300. The cams are suitably rotated relative to one another so as to define one or more angular operation ranges of the valve or actuator to which the shaft 410 is restrained. In the illustrated embodiment two cams 420, 430 are e.g. shown.

FIG. 1 only shows the bottom of the container 200, which comprises a pair of through openings 201, 202 configured to allow mounting of electric cables (not shown) connectable to a terminal 303 of the electric circuit 300. The shaft 410 is rotatably restrained to the container 200 and extends from its lower part at right angles to the electric circuit 300, crossing it at a central opening about which the limit switches 301, 302 are arranged.

The container 200 also comprises in a known manner an upper part (not shown) configured to enclose the electric circuit 300 and the driving assembly 400 with the bottom.

Figure 3:
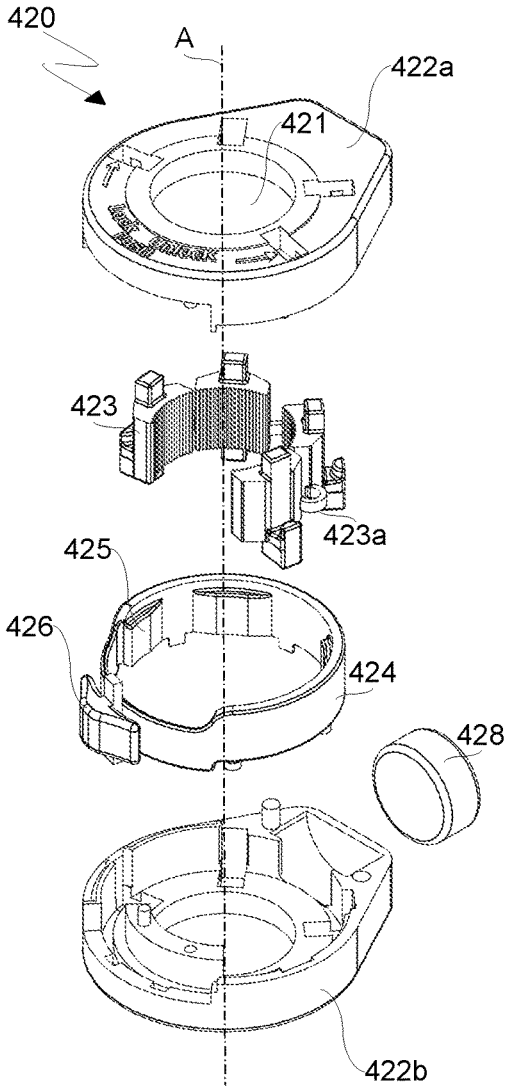

Now referring to FIGS. 2 and 3, as explained above the driving assembly 400 comprises a shaft 410 and one or more cams keyed thereon and configured to control the proximity sensors and/or of the limit switches. For simplicity's sake FIG. 2 only shows one cam, e.g. cam 420, but it will be appreciated that cam 430 and any other cam mounted on the shaft 410 of the driving assembly 400 are identical to cam 420 in the frame of the present invention.

According to the invention, the shaft 410 includes a gripping surface 411 and the cam 420 includes a radial clamping mechanism whose gripping members are arranged at an assembly through hole 421 configured to allow to key the cam on the shaft 410.

With reference to FIG. 3, the cam 420 comprises a container 422. Said container is e.g. a shell consisting of a lower half shell 422*a* and an upper half shell 422*b* between which a plurality of gripping members 423 movable to and from the axis A of the assembly through hole 421 are housed so as to allow locking of the cam 420 on the gripping surface 411 of the shaft 410.

In the illustrated embodiment, the gripping members 423 are e.g. radially movable relative to the shell container 422 and to this aim radial grooves configured to receive pins of matching shape of the gripping elements 423 are formed in the two half-shells 422*a*, 422*b*. It will be appreciated that the gripping members might equivalently comprise grooves and be guided along radial rails having a matching shape.

Alternatively, the gripping elements 423 could be guided along helical grooves, rotatably pivoted on the half-shells or restrained to the shell container through equivalent kinematic mechanisms.

In order to allow radial movement of the gripping elements 423 to and from the axis A of the assembly through hole 421, the cam 420 comprises an annular element 424 having a plurality of bumps 425 formed on its inner surface. The number of bumps 425 corresponds to the number of the gripping elements 423. On the outer surface of the annular element 424 maneuvering means 426 are also formed, which allow a user to grasp and rotate the annular element 424 relative to the shell container 422 selectively between an unlocking position and a locking position as will be described in detail hereinafter.

In an assembled configuration of the cam 420, the annular element 424 and the gripping elements 423 are enclosed between the lower half shell 422*a* and the upper half shell 422*b* and the annular element 424 surrounds the gripping elements 423 that face the assembly through hole 421.

The maneuvering means 426 are accessible through a peripheral aperture 427 of the shell 422 that extends in the circumferential direction. Advantageously, the maneuvering means may be configured as a slider protruding from the peripheral aperture 427, which can be simply grasped and moved with a user's finger.

Figure 4:
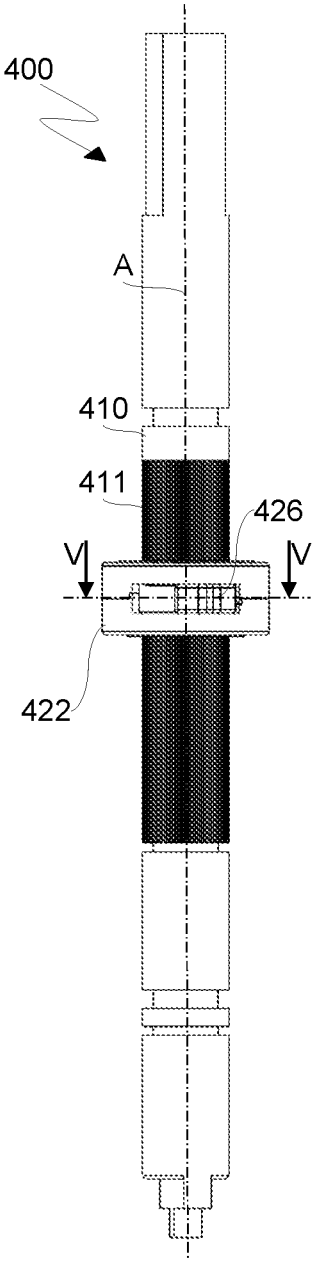
FIG. 4 is a front view of the driving assembly.
Figure 5:
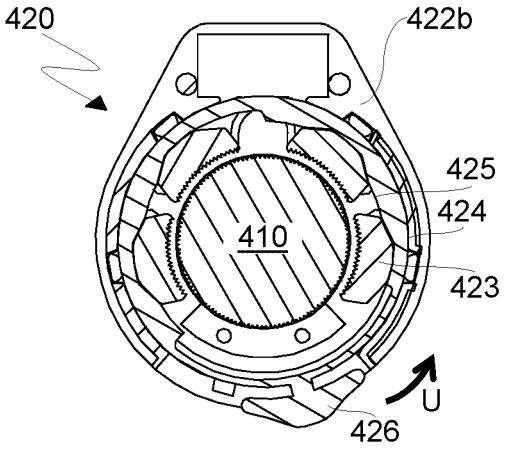
FIG. 5 is a cross-sectional view of the driving assembly taken along a plane passing through line V-V of FIG. 4, showing the cam in an unlock configuration relative to the shaft.
Figure 6:
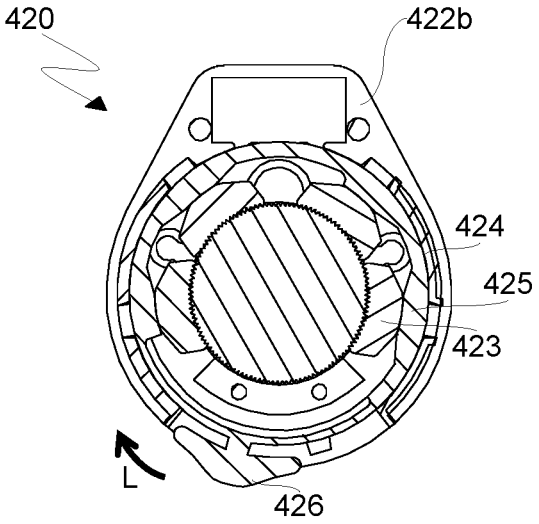
FIG. 6 is a cross-sectional view similar to that of FIG. 5, wherein the cam is locked on the shaft.

With reference to FIGS. 4 to 6, the configuration of the gripping elements 423, the annular element 424 and its bumps 425 is such that by rotating the annular element 424 in a first direction, e.g. counterclockwise as indicated by arrow U in FIG. 5, each gripping members 423 is located between two consecutive bumps 425 and does not protrude from the hole 421. In this condition, the cam 420 is free to rotate relative to the shaft 410 and may therefore be arranged at any angular position relative thereto. It is thus possible to adjust the position of a cam so that it has a position suitable to drive a limit switch mounted on the electric circuit 300.

By rotating the annular element 424 in a second direction opposite the first direction, e.g. in a clockwise direction as indicated by arrow L in FIG. 6, the bumps 425 press against the gripping members 423 thus causing them to move towards the axis A of the hole 421 by following a trajectory determined by their respective kinematic constraints. The gripping members 423 protrude from the hole 421 and contact the gripping surface 411 formed on the shaft 410. In this condition, the cam 420 is locked on the shaft, thus ensuring maintenance of the driving position of the limit switch mounted the electric circuit 300.

According to a preferred embodiment of the invention, the gripping surface 411 formed on the shaft and the surfaces of the gripping members 423 facing towards the inside of the assembly through hole 421 of the cam 420 are ribbed surfaces which extend longitudinally parallel to the cam axis A, i.e. the axis of shaft 410, in other words surfaces comprising a plurality of alternating lands and grooves which allow to achieve a shape coupling between cam and shaft. The position adjustment is extremely accurate and allows to prevent accidental relative rotations between cam and shaft thanks to the shape coupling between the lands and grooves of the surfaces.

Additionally or alternatively it is possible to configure the gripping surface 411 formed on the shaft 410 and the surfaces of the gripping members 423 facing the inside of the assembly through hole 421 of the cam 420 so as to realize a force fit. To this aim, the annular element 424 with the respective bumps 425 and the gripping members 423 are so sized that the gripping members are caused to make a stroke toward the axis of the through hole 421 of the cam 420 larger than the radial play between the through hole and the shaft 410, whereby in the locking condition a slight interference between shaft and cam is generated, which results in a radial compression force.

In the case of ribbed surfaces, this configuration advantageously allows to avoid any problem caused by manufacturing tolerances of the components of the driving assembly 400.

More generally, this configuration may be exploited to achieve a frictional engagement between cams and shaft instead of resorting to a shape coupling, which offers the advantage of a cheaper configuration of the driving assembly 400. In order to increase the coefficient of friction between the surfaces knurls and/or materials having a high coefficient of friction may be used such as rubber, polyurethane and plastic materials.

By referring again to FIG. 3, according to a preferred embodiment of the invention, the gripping members 423 are restrained to one another along the circumferential direction through connecting elements 423*a* and together form a crown-shaped body that may be fitted into the shell container 422 of the cam 420 more easily than the single gripping members 423.

The connecting elements 423*a* are preferably of a resilient type, e.g. having an arcuate shape as in the illustrated embodiment, and are configured to urge the individual gripping members 423 away from each other in a circumferential direction, so that by rotating the annular element 424 from the locking to the unlocking position they are moved substantially in a snapping manner between consecutive bumps 425 thus releasing the gripping surface 411 of the shaft 410.

Still referring to FIG. 3, the shell 422 of the cam 420 may further include a seat housing an element 428 made of ferromagnetic material suitable to interact with a limit switch of the electric circuit 300 configured as a proximity sensor. This configuration is advantageous because the cams not only accommodate a radial clamping mechanism that allows to key them on a shaft, but are also suitable for either direct interaction with limit switches having a push button or indirect interaction with proximity sensors.

Figure 7:
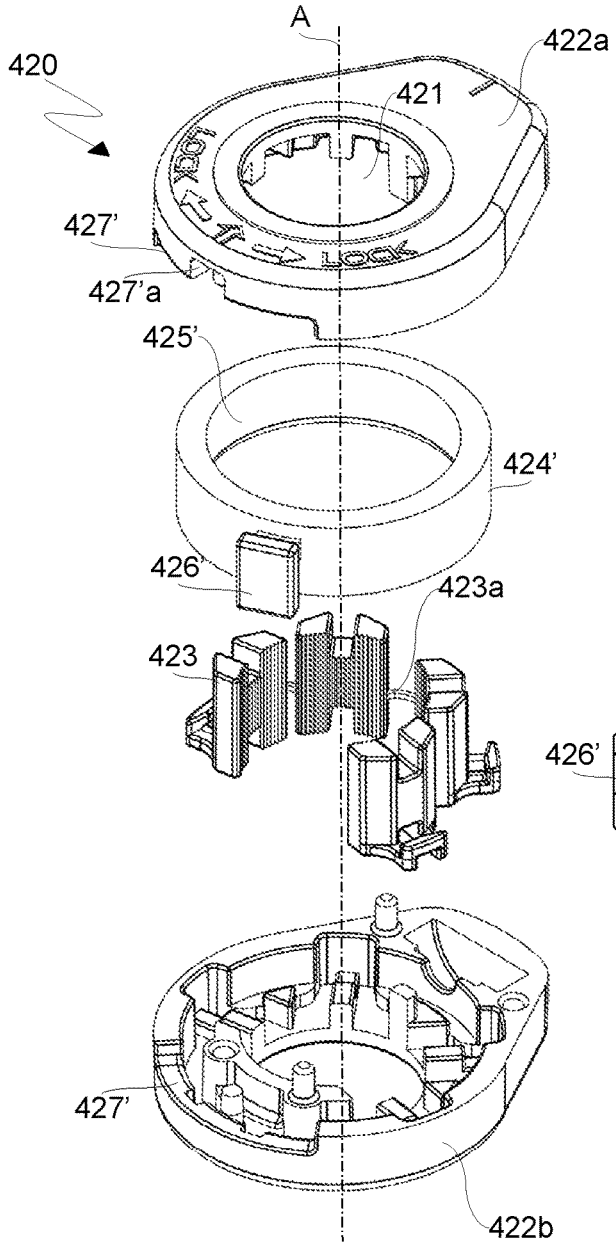
FIG. 7 is a perspective exploded view of a first alternative embodiment of the cam of the driving assembly of the device according to the invention.
Figure 8:
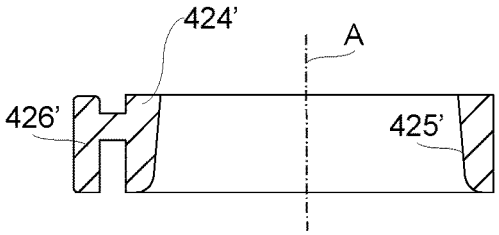
FIG. 8 is a longitudinal sectional view of moving means of the cam of FIG. 7.

Now referring to FIGS. 7 and 8 a first alternative embodiment of the cam of the driving assembly according to the invention will be disclosed.

With respect to the embodiment disclosed above, the moving means of the gripping members 423 in this case comprise an annular element 424' axially restrained within the container 422. The annular element 424' surrounds the gripping members 423 and, as shown in the longitudinal section of FIG. 8, has a conical inner annular surface 425'.

The annular element 424' is selectively movable between an unlocking and a locking position of the cam 420 on the shaft 410. In the unlocking position of the cam 420 the annular element 424' is axially spaced from the gripping members 423 which are thus spaced from the conical annular inner surface 425' and do not protrude from the periphery of the assembly through hole 421 of the cam 420. In the locking position the annular element 424' is instead moved axially so that the conical inner annular surface 425' pushes the gripping members 423 thus causing them to move radially beyond the periphery of the through hole 421 of the cam 420 towards its axis A, which allows the cam to grip the shaft 410.

Maneuvering means 426' are formed on the outer surface of the annular element 424', the maneuvering means being configured so as to allow to move the annular element between the locking and unlocking positions. The maneuvering means 426' may be accessed from the outside of the shell container 422 of the cam 420 through an aperture 427' formed therein, which extends in the circumferential and axial direction of the shell container 422. It will be appreciated that in order to allow axial movement of the annular element 424' so as to unlock the cam, the aperture 427' features a notch out portion 427'*a* in the axial direction.

Figure 9:
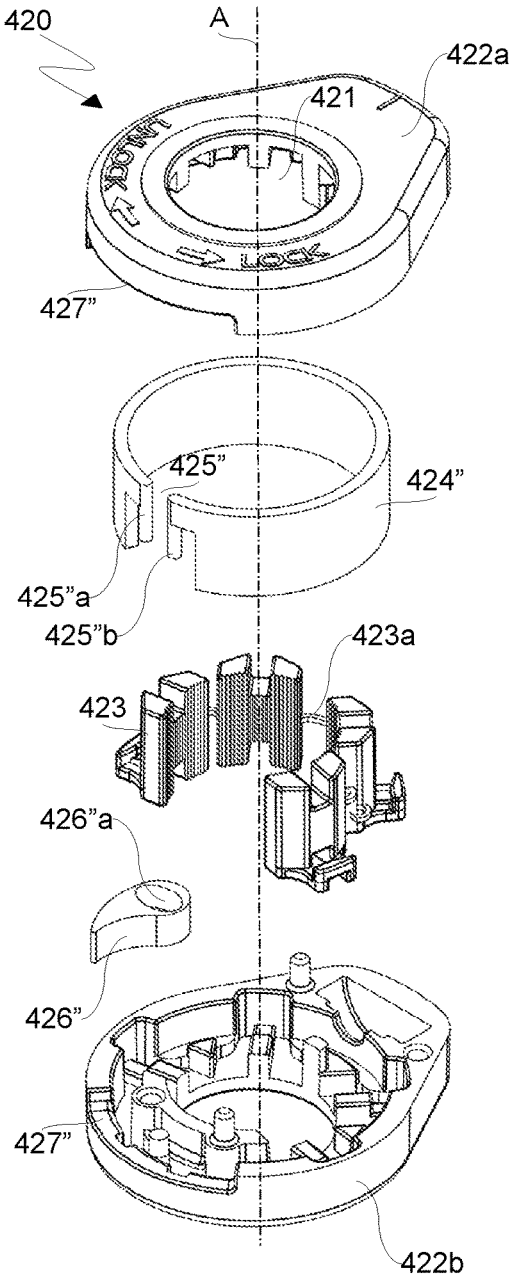
FIG. 9 is a perspective exploded view of a second alternative embodiment of the cam of the driving assembly of the device according to the invention.
Figure 10:
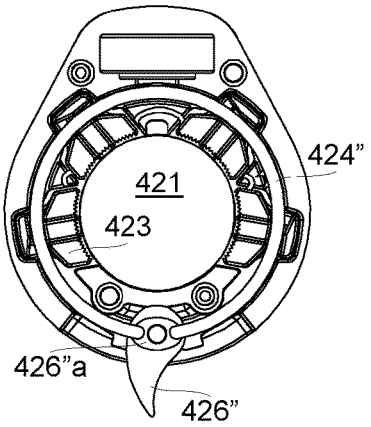
FIGS. 10 and 11 are top views showing the cam of FIG. 9 without its upper half-shell in an unlocked and locked configuration, respectively.
Figure 11:
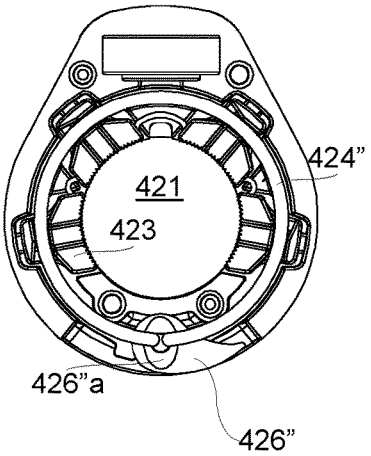

Now referring to FIGS. 9 to 11, a second alternative embodiment of the cam of the driving assembly according to the invention is disclosed.

In this case the moving means comprise an annular element 424" restrained inside the container 422 about the gripping members 423. The annular element 424" features a circumferential gap 425", whereby it is open and has a certain elasticity. In the unlocking position the end portions of the circumferential gap 425" facing each other are spaced from one another and the gripping members 423 do not protrude beyond the periphery of the assembly through hole 421 of the cam 420. In the locking position the end portions of the circumferential gap 425" are brought close to each other thus being substantially in contact with each other, whereby the annular element 424" pushes the gripping members 423 thus causing them to move beyond the periphery of the through hole 421 of the cam 420 towards its axis A.

In order to allow to operate the annular element 424", a pair of pins 425"*a*, 425"*b* are formed at the end portions of the circumferential gap 425", respectively, and the moving means comprise maneuvering means 426" in the form of a lever pivoted on the container 422. The lever means 426" comprise an elliptic aperture 426"a configured to engage the maneuvering pins 425"*a*, 425"*b*.

With reference to FIGS. 10 and 11, the overall configuration is such that in the unlocking position the lever means 426" are rotated outwards relative to the container 422 and the maneuvering pins 425"*a*, 425"*b* are spaced away from each other at opposite ends of said elliptic aperture 426"*a* in the direction of its longer axis, whereby the gripping members 423 do not protrude beyond the periphery of the assembly through hole 421 of the cam 420. On the contrary, in the locking position the lever means 426" are rotated inwards relative to the container 422 and the maneuvering pins 425"*a*, 425"*b* are substantially adjacent to each other at opposite ends of the elliptic aperture 426"*a* in the direction of its shorter axis, whereby the annular element 424" pushes the gripping members 423 and causes them to move beyond the periphery of the through hole 421 of the cam 420 towards its axis A, which allows to grip the shaft 410.

The present invention has hereto been described with reference to preferred embodiments thereof. It will be appreciated that that there may be other embodiments relating to the same inventive idea, as defined by the scope of protection of the claims set forth below.

The invention claimed is:

1. A control device with limit switches, said device comprising a container housing:

an electric circuit provided with one or more limit switches, and a driving assembly configured to control operation of a valve or an actuator through said limit switches of said electric circuit, wherein said driving assembly comprises a shaft, configured to be rotatably coupled to a valve or an actuator, and one or more cams keyed on said shaft and configured for driving the limit switches of the electric circuit, wherein the shaft comprises a gripping surface, and wherein each cam comprises a radial clamping mechanism whose gripping members are arranged in correspondence of a through hole of the cam configured to allow to key the cam onto the shaft, wherein each cam comprises a container wherein a plurality of gripping members of said radial clamping mechanism are arranged, said gripping members being movable within said container to and from an axis (A) of said through hole of the cam, and in that each cam further comprises a moving means configured to move the gripping members.

2. The control device according to claim 1, wherein said container is a shell container consisting of a lower half-shell and an upper half-shell between which the gripping members of the radial clamping mechanism are housed.

3. The control device according to claim 1, wherein, said moving means comprise an annular element arranged on an inside of the container and rotatably restrained thereto, said annular element surrounding the gripping members and being provided with a plurality of bumps formed on an inner surface of the annular element, the plurality of bumps corresponding to the plurality of gripping members.

4. The control device according to claim 3, wherein said annular element is selectively movable between an unlocking position and a locking position of the cam on the shaft, the overall configuration of the annular element being such that in the unlocking position the gripping elements are located between two consecutive bumps and do not protrude beyond a periphery of the through hole of the cam, while in the locking position the bumps press against the gripping elements causing them to move beyond the periphery of the through hole of the cam towards the axis (A) of the through hole of the cam.

5. The control device according to claim 4, wherein a maneuvering means are formed on an outer surface of the annular element, said maneuvering means being configured to allow displacement of the annular element between the unlocking and locking positions.

6. The control device according to claim 5, wherein said maneuvering means are accessible from the outside of the container shell of the cam through an aperture formed therein, said aperture stretching along a circumferential direction of the container shell.

7. The control device according to claim 6, wherein the maneuvering means are configured as a slider protruding from said aperture.

8. The control device according to claim 1, wherein said moving means comprise an annular member arranged on an inside of the container and axially restrained thereto, said annular member surrounding the gripping members and having a conical annular inner surface.

9. The control device according to claim 8, wherein said annular member is selectively movable between an unlocking position and a locking position of the cam on the shaft, the overall configuration of the annular member being such that in the unlocking position the annular member is axially spaced from the gripping members, which are thus spaced from the conical annular inner surface and do not protrude beyond a periphery of the through hole of the cam, whereas in the locking position the annular member is moved in the axial direction so that the conical annular inner surface urges the gripping members thus causing them to move beyond the periphery of the through hole of the cam toward the axis (A) of the through hole of the cam.

10. The control device according to claim 9, wherein a maneuvering means are formed on an outer surface of the annular element, said maneuvering means being configured so as to allow displacement of the annular element between the unlocking and locking positions.

11. The control device according to claim 10, wherein said maneuvering means are accessible from the outside of the container shell of the cam through an aperture formed therein, said aperture stretching along a circumferential direction of the container shell.

12. The control device according to claim 1, wherein said moving means comprise an annular member restrained on an inside of the container, said annular member surrounding the gripping members and featuring a circumferential gap, the overall configuration of the annular member being such that in the unlocking position end portions of said circumferential gap face each other and are spaced apart and the gripping members do not protrude beyond a periphery of the through hole of the cam, whereas in the locking position end portions of the circumferential gap substantially contact each other, thereby causing the annular member to push against the gripping members thus making them to move beyond the periphery of the through hole of the cam toward the axis (A) of the through hole of the cam.

13. The control device according to claim 12, wherein a pair of maneuvering pins are formed on the end portions of the circumferential gap facing each other, and said moving means further comprise a maneuvering means in the form of a lever, said lever maneuvering means being hinged on the container and comprising an elliptic aperture configured to engage said maneuvering pins.

14. The control device according to claim 1, wherein the gripping surface formed on the shaft and surfaces of the gripping members facing the axis (A) of the through hole of the cam are ribbed surfaces stretching out in a direction parallel to the cam axis (A).

15. The control device according to claim 1, wherein the gripping members are restrained to one another in a circumferential direction by way of connecting elements and wherein the gripping members so restrained form a crown-shaped body.

16. The control device according to claim 15, wherein the connecting elements are resilient elements configured to urge the gripping members away from one another in the circumferential direction.

* * * * *